US009588457B2

(12) United States Patent
Otana

(10) Patent No.: US 9,588,457 B2
(45) Date of Patent: Mar. 7, 2017

(54) OPTICAL SCANNING DEVICE AND IMAGE FORMING APPARATUS

(71) Applicant: KYOCERA Document Solutions Inc., Osaka (JP)

(72) Inventor: Aiichiro Otana, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/162,983

(22) Filed: May 24, 2016

(65) Prior Publication Data

US 2016/0349663 A1 Dec. 1, 2016

(30) Foreign Application Priority Data

May 26, 2015 (JP) ..... 2015-106223

(51) Int. Cl.
*G03G 15/043* (2006.01)
*G03G 21/20* (2006.01)

(52) U.S. Cl.
CPC ..... *G03G 15/043* (2013.01); *G03G 21/20* (2013.01)

(58) Field of Classification Search
CPC ..... G03G 15/043; G03G 21/20
See application file for complete search history.

(56) References Cited

U.S. PATENT DOCUMENTS 5,130,839 A * 7/1992 Tomita ..... G02B 3/14 349/200
5,450,211 A * 9/1995 Kanai ..... G02B 26/126 347/134
5,974,062 A * 10/1999 Yasuda ..... H01S 3/1312 372/34

FOREIGN PATENT DOCUMENTS

JP 60100111 A * 6/1985
JP 2001-51214 2/2001

* cited by examiner

*Primary Examiner* — G. M. Hyder
(74) *Attorney, Agent, or Firm* — Wenderoth, Lind & Ponack, L.L.P.

(57) ABSTRACT

An image forming lens is fixed to a protruding seat part, which protrudes from a bottom wall part of a casing, by using an adhesive. A concave portion is formed at an end surface of a protruding side of the protruding seat part to receive a temperature sensor. The adhesive is filled in the concave portion to fix the temperature sensor and is interposed between the end surface of the protruding side of the protruding seat part and the image forming lens to fix the image forming lens to the protruding seat part.

3 Claims, 6 Drawing Sheets

OPTICAL SCANNING DEVICE AND IMAGE FORMING APPARATUS

CROSS-REFERENCE TO RELATED APPLICATION

This application is based upon and claims the benefit of priority from Japanese Patent Application No. 2015-106223 filed on May 26, 2015, the entire contents of which are incorporated herein by reference.

BACKGROUND

The technology of the present disclosure relates to an optical scanning device and an image forming apparatus.

In general, an optical scanning device mounted in an image forming apparatus such as a copy machine has a light source, an optical deflector that deflects optical beams emitted from the light source and allows the deflected optical beams to be scanned in a main scanning direction, and an image forming lens that forms an image of the optical beams, which have been deflected and scanned by the optical deflector, on a surface to be scanned at a constant velocity.

In this type of optical scanning device, the temperature of the image forming lens is changed according to the operation of the optical deflector, resulting in a change in a bending modulus thereof. Therefore, there is a problem that the position in the main scanning direction of scanning light having passed through the image forming lens changes and thus image failure (image failure such as a color shift in the case of a color machine) occurs.

In this regard, there is proposed a technology of detecting the surface temperature of the image forming lens by a temperature sensor and correcting a writing position or a writing start timing of an image on the basis of the detected temperature, thereby correcting a position shift in the main scanning direction of the scanning light. The temperature sensor is provided at an upper side of the image forming lens.

SUMMARY

An optical scanning device according to one aspect of the present disclosure includes a light source, a deflection unit, an image forming lens, and a temperature sensor. The light source emits optical beams. The deflection unit is received in a casing. The deflection unit deflects the optical beams emitted from the light source and allows the deflected optical beams to be scanned in a main scanning direction. The image forming lens is fixed to a protruding seat part, which protrudes from a bottom wall part of the casing, by using an adhesive. The image forming lens forms an image of the optical beams deflected and scanned by the deflection unit on a surface to be scanned at a constant velocity. The temperature sensor detects the temperature of the image forming lens.

A concave portion is formed at an end surface of a protruding side of the protruding seat part to allow for receiving of the temperature sensor. The adhesive is filled in the concave portion to fix the temperature sensor. The adhesive is configured to be interposed between the end surface of the protruding side of the protruding seat part and the aforementioned image forming lens and to fix the image forming lens to the protruding seat part.

DETAILED DESCRIPTION

Hereinafter, an example of an embodiment will be described in detail on the basis of the drawings. It is noted that the technology of the present disclosure is not limited to the following embodiments.

Embodiment

Figure 1:
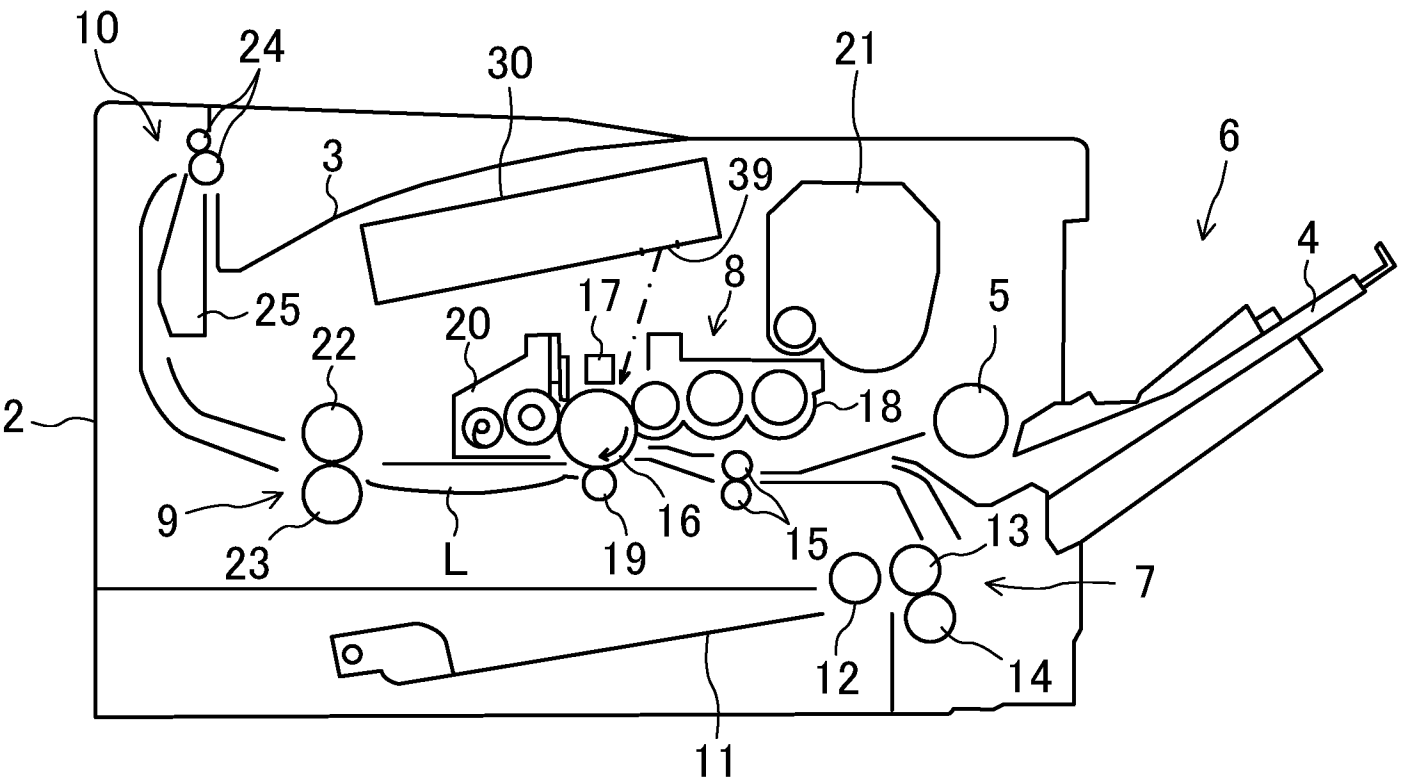
FIG. 1 is a schematic configuration diagram illustrating an image forming apparatus including an optical scanning device in an embodiment.

FIG. 1 is a sectional view illustrating a schematic configuration of a laser printer 1 as an image forming apparatus in the present embodiment.

As illustrated in FIG. 1, the laser printer 1 includes a box-like printer body 2, a manual paper feeding unit 6, a cassette paper feeding unit 7, an image forming unit 8, a fixing unit 9, and a paper discharge unit 10. Accordingly, the laser printer 1 is configured to form an image on a paper on the basis of image data transmitted from a terminal and the like (not illustrated) while conveying the paper along a conveyance path L in the printer body 2.

The manual paper feeding unit 6 has a manual tray 4 provided at one side portion of the printer body 2 so as to be openable and closable, and a manual paper feeding roller 5 provided in the printer body 2 so as to be rotatable.

The cassette paper feeding unit 7 is provided at a bottom wall portion of the printer body 2. The cassette paper feeding unit 7 includes a paper feeding cassette 11 that stores a plurality of papers overlapped one another, a pick roller 12 that takes out the papers in the paper feeding cassette 11 one by one, and a feed roller 13 and a retard roller 14 that separate the taken-out papers one by one and send the separated paper to the conveyance path L.

The image forming unit 8 is provided above the cassette paper feeding unit 7 in the printer body 2. The image forming unit 8 includes a photosensitive drum 16 serving as an image carrying member provided in the printer body 2 so as to be rotatable, a charging device 17, a developing unit 18, a transfer roller 19, and a cleaning unit 20, an optical scanning device 30 arranged above the photosensitive drum 16, and a toner hopper 21, wherein the charging device 17, the developing unit 18, the transfer roller 19, and the cleaning unit 20 are arranged around the photosensitive drum 16. Accordingly, the image forming unit 8 is configured to form an image on the paper supplied from the manual paper feeding unit 6 or the cassette paper feeding unit 7. At the conveyance path L, a pair of resist rollers 15 are provided to temporarily keep the taken-out paper waiting and then supply the paper to the image forming unit 8 at a predetermined timing.

The fixing unit 9 is arranged at a lateral side of the image forming unit 8. The fixing unit 9 includes a fixing roller 22 and a pressure roller 23, which rotate in press-contact with each other. Accordingly, the fixing unit 9 is configured to fix a toner image, which has been transferred to the paper in the image forming unit 8, to the paper.

The paper discharge unit 10 is provided above the fixing unit 9. The paper discharge unit 10 includes a paper discharge tray 3, a paper discharge roller pair 24 for conveying the paper to the paper discharge tray 3, and a plurality of conveying guide ribs 25 for guiding the paper to the paper discharge roller pair 24. The paper discharge tray 3 is formed in a concave shape at an upper portion of the printer body 2.

When the laser printer 1 receives image data, the photosensitive drum 16 is rotationally driven and the charging device 17 charges the surface of the photosensitive drum 16 in the image forming unit 8.

Then, on the basis of the image data, optical beams are emitted from the optical scanning device 30 to the photosensitive drum 16. The optical beams are irradiated, so that an electrostatic latent image is formed on the surface of the photosensitive drum 16. The electrostatic latent image formed on the photosensitive drum 16 is developed in the developing unit 18 and thus becomes a visible image as a toner image.

Thereafter, the paper passes through between the transfer roller 19 and the photosensitive drum 16. At this time, the toner image of the photosensitive drum 16 is transferred to the paper by transfer bias applied to the transfer roller 19. The paper with the transferred toner image is heated and pressed by the fixing roller 22 and the pressure roller 23 in the fixing unit 9. As a consequence, the toner image is fixed to the paper.

Figure 2:
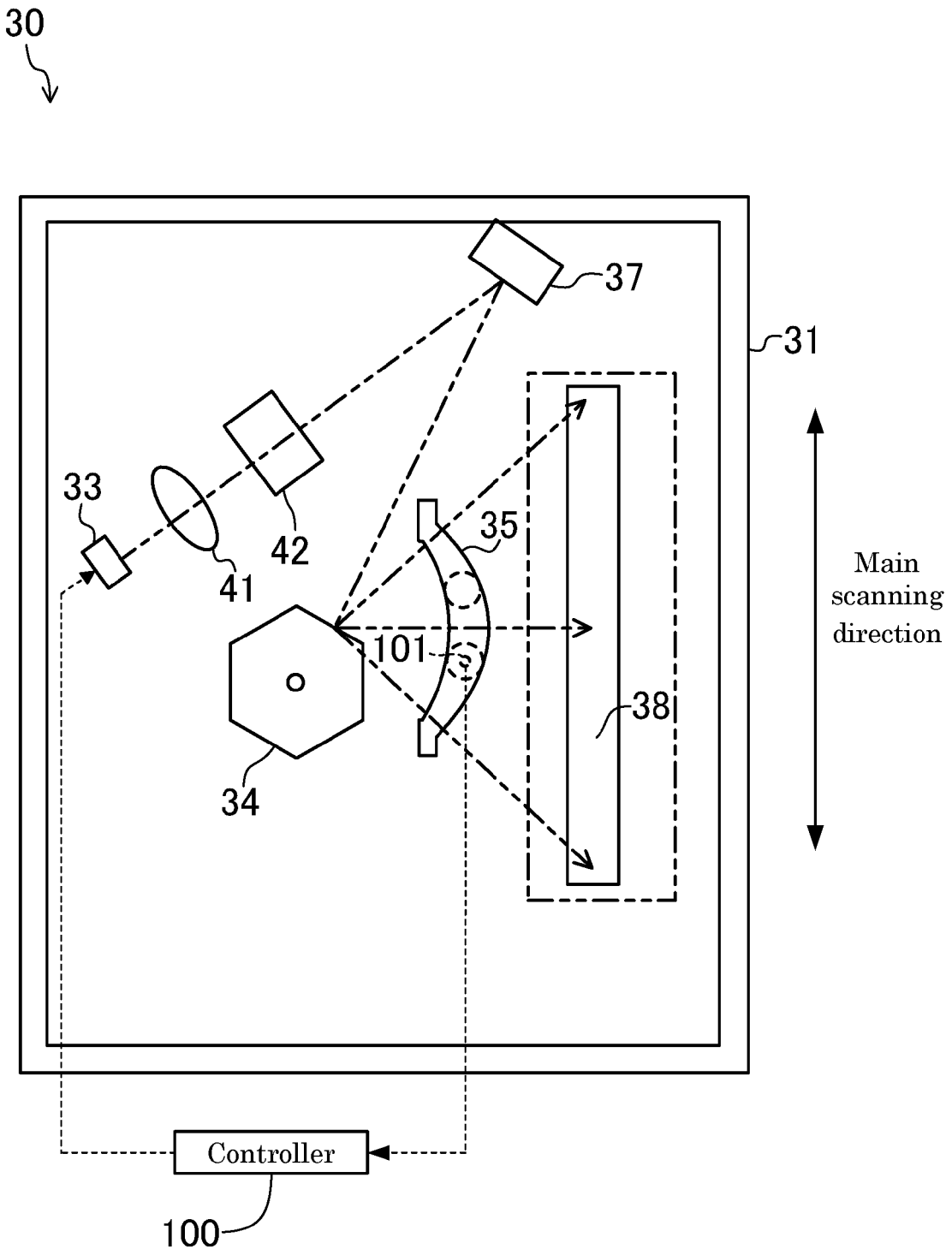
FIG. 2 is a diagram illustrating an optical scanning device in an embodiment.

As illustrated in FIG. 2, the optical scanning device 30 includes a casing 31, a polygon mirror (corresponding to a deflection unit) 34 received in the casing 31 to reflect light from a light source 33, an image forming lens 35 provided on an optical path of optical beams reflected by the polygon mirror 34 in the casing 31, and a lid member (not illustrated) mounted in the casing 31.

The polygon mirror 34 is provided at a bottom wall part of the casing 31 via a polygon motor (not illustrated). The polygon mirror 34 is a rotating polygon mirror and is rotationally driven by the polygon motor.

As illustrated in FIG. 2, the light source 33 is arranged near a side wall part of the casing 31. The light source 33, for example, is a laser light source having a laser diode. The light source 33 emits optical beams toward a reflection mirror 37 arranged at the bottom wall part of the casing 31. The reflection mirror 37 reflects the optical beams from the light source 33 and allows the reflected optical beams to be incident into the polygon mirror 34. It is noted that in the drawing, a reference numeral 41 indicates a collimator lens and a reference numeral 42 indicates a cylindrical lens 42.

The image forming lens 35, for example, is a fθlens, and is installed at the bottom wall part of the casing 31 at a lateral side of the polygon mirror 34 as illustrated in FIG. 2. The image forming lens 35 has a long shape which is long in a main scanning direction. The thickness (a dimension in a right and left direction of FIG. 2 and a dimension in an optical axis direction) of the image forming lens 35 is maximum at a center portion in the main scanning direction and is gradually reduced toward both end portions in the main scanning direction. The height of the image forming lens 35 is constant in the main scanning direction.

Inside the aforementioned casing 31, a reflection mirror 38 is arranged. The reflection mirror 38 is arranged at an opposite side of the polygon mirror 34 side with respect to the image forming lens 35. The reflection mirror 38 extends in a long shape along the main scanning direction.

In the optical scanning device 30 configured as above, optical beams emitted from the light source 33 are collected in the polygon mirror 34 via the collimator lens 41, the cylindrical lens 42, and the reflection mirror 37. The optical beams collected in the polygon mirror 34 are reflected by a reflection surface of the polygon mirror 34 and are incident into the image forming lens 35 as scanning light. The scanning light having passed through the image forming lens 35 is reflected by the reflection mirror 38, passes through an opening 39 (see FIG. 1), and is irradiated to the photosensitive drum 16 outside the casing 31. In this way, an image of the scanning light is formed on the surface (corresponding to a surface to be scanned) of the photosensitive drum 16. The scanning light, the image of which has been formed on the surface of the photosensitive drum 16, forms an electrostatic latent image on the surface of the photosensitive drum 16 while scanning the surface of the photosensitive drum 16 in the main scanning direction according to the rotation of the polygon mirror 34.

Figure 3:
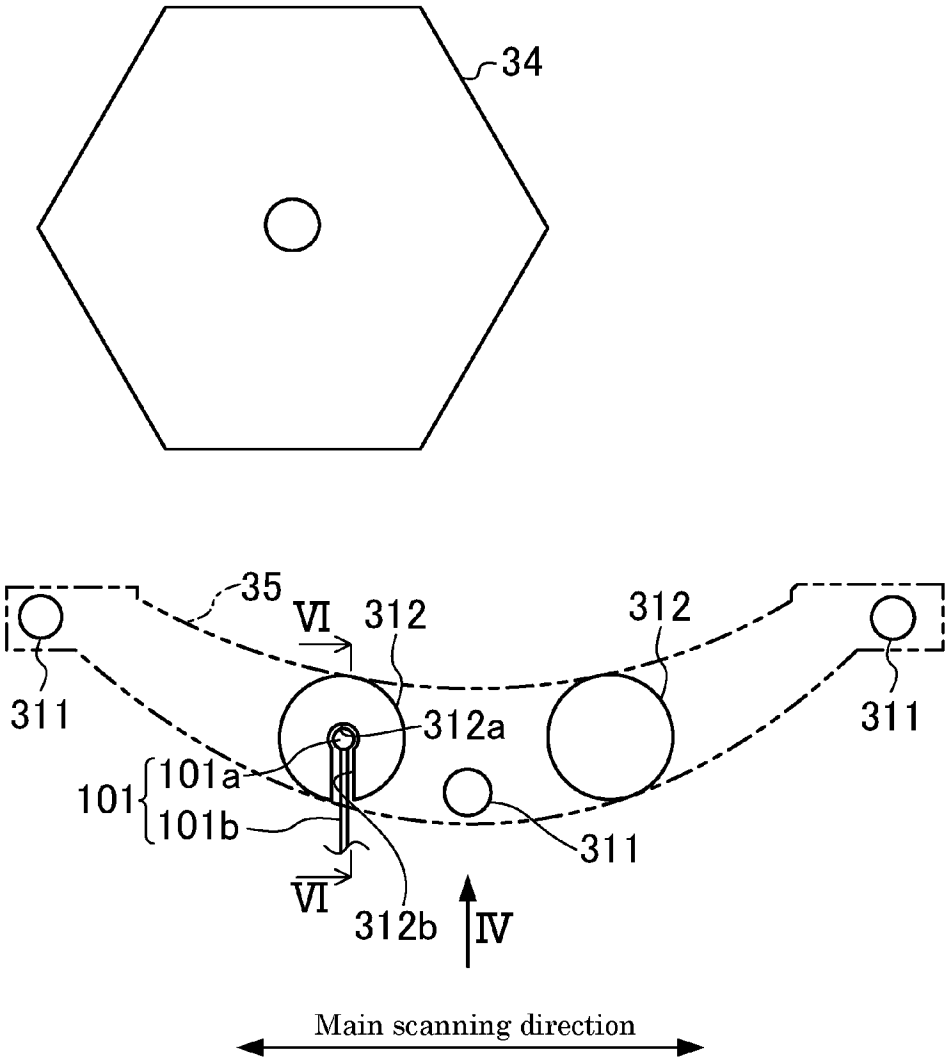
FIG. 3 is a plan view illustrating a part at which an image forming lens and a polygon mirror have been fixed in an optical scanning device.

The operation of the aforementioned light source 33 is controlled by a controller 100. The controller 100 is connected to a temperature sensor 101 arranged between the image forming lens 35 and the bottom wall part of the casing 31. The temperature sensor 101 is a sensor for measuring the temperature of the image forming lens 35. As illustrated in FIG. 3, the temperature sensor 101 has a sensor body 101*a* and a wiring 101*b*. The sensor body 101*a* converts the detected temperature into an electrical signal and outputs the electrical signal. The wiring 101*b* transmits the electrical signal, which is outputted from the sensor body 101*a*, to the controller 100.

The controller 100 performs correction control. The correction control, for example, is control that controls a clock frequency of the light source 33 based on the detected temperature by the temperature sensor 101 (the sensor body 101*a*), thereby correcting a position shift in the main scanning direction of the optical beams having passed through the image forming lens 35. The correction control is performed based on correction data stored in a memory of the controller 100.

As illustrated in FIG. 3, the image forming lens 35 is supported by three positioning bosses 311 from below. The three positioning bosses 311 are columnar bosses protruding to the image forming lens 35 side from the bottom wall part of the casing 31. The three positioning bosses 311 perform the positioning in the height direction of the image forming lens 35. The three positioning bosses 311 support both end portions and the center portion in the main scanning direction of the image forming lens 35, respectively.

Figure 4:
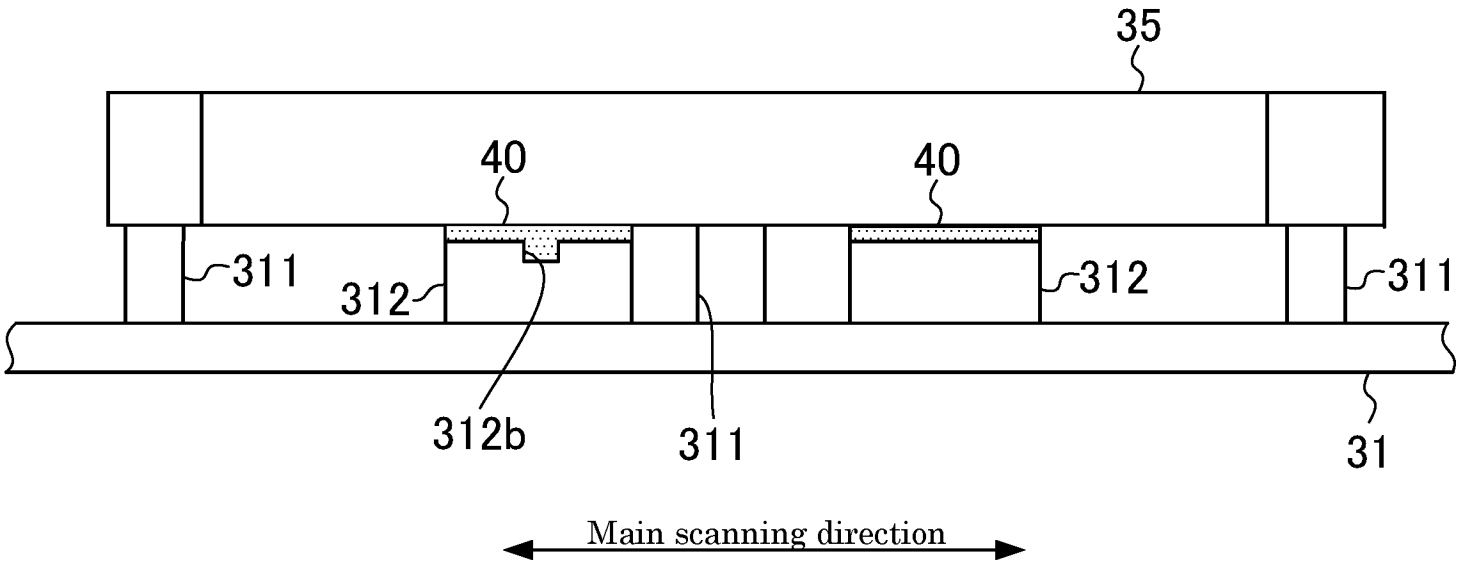
FIG. 4 is a view viewed in the arrow direction of IV of FIG. 3.

A columnar protruding seat part 312 is provided between the three positioning bosses 311 one by one (two in total). The two protruding seat parts 312 protrude to the image forming lens 35 side from the bottom wall part of the casing 31. An external diameter of each protruding seat part 312 is larger than that of the positioning boss 311. A height of each protruding seat part 312 is slightly lower than that of the positioning boss 311. Consequently, in the state in which the image forming lens 35 has been set on the positioning bosses 311, a space is formed between an end surface of the protruding side of each protruding seat part 312 and the image forming lens 35. In these spaces, an adhesive 40 (see FIG. 4) is filled, and the image forming lens 35 adheres to and is fixed to the end surface of the protruding side of each protruding seat part 312 via the adhesive 40. The adhesive 40, for example, includes a photocurable resin. It is noted that the adhesive 40 is not limited to the photocurable resin and for example, may also be a thermosetting resin and the like.

Figure 5:
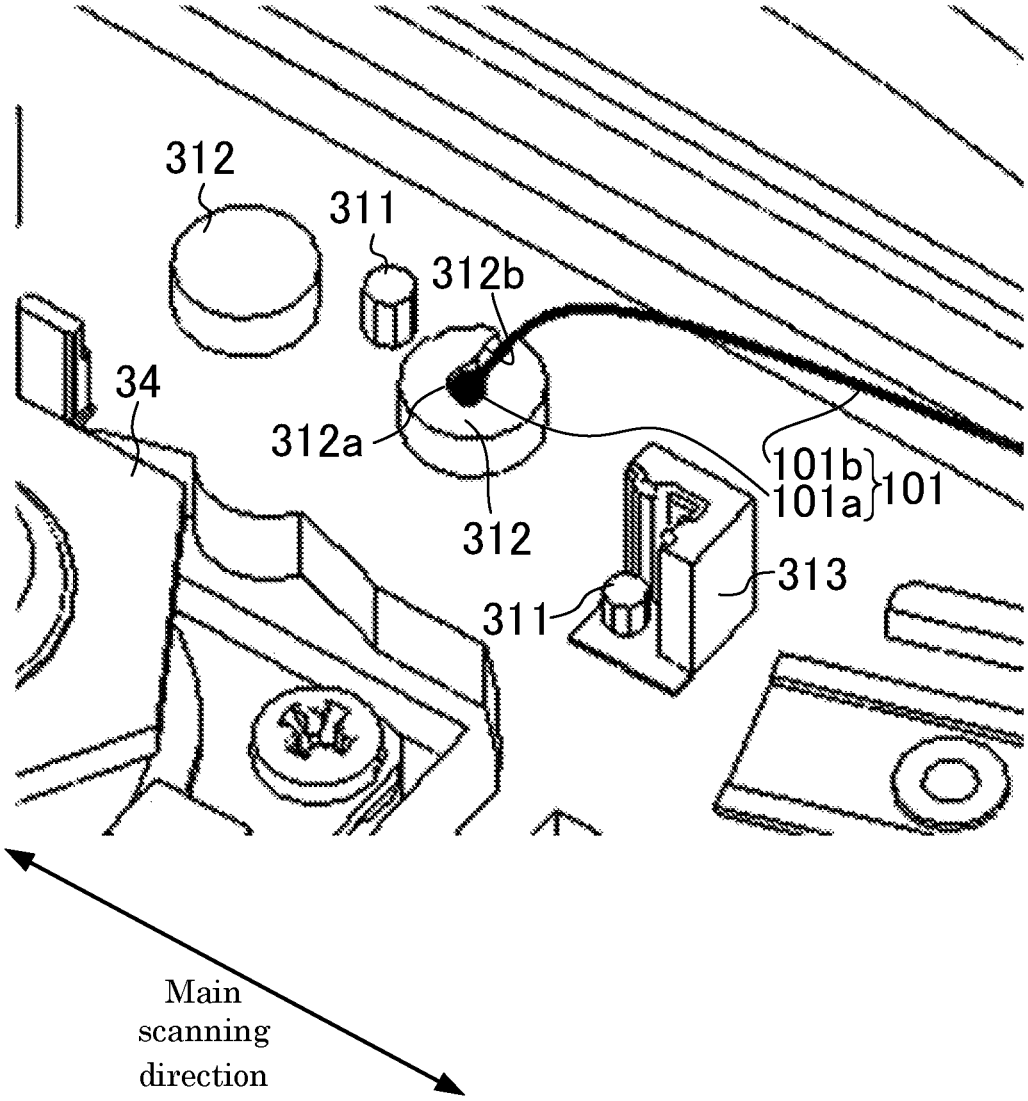
FIG. 5 is an enlarged perspective view illustrating protruding seat portions for fixing an image forming lens.
Figure 6:
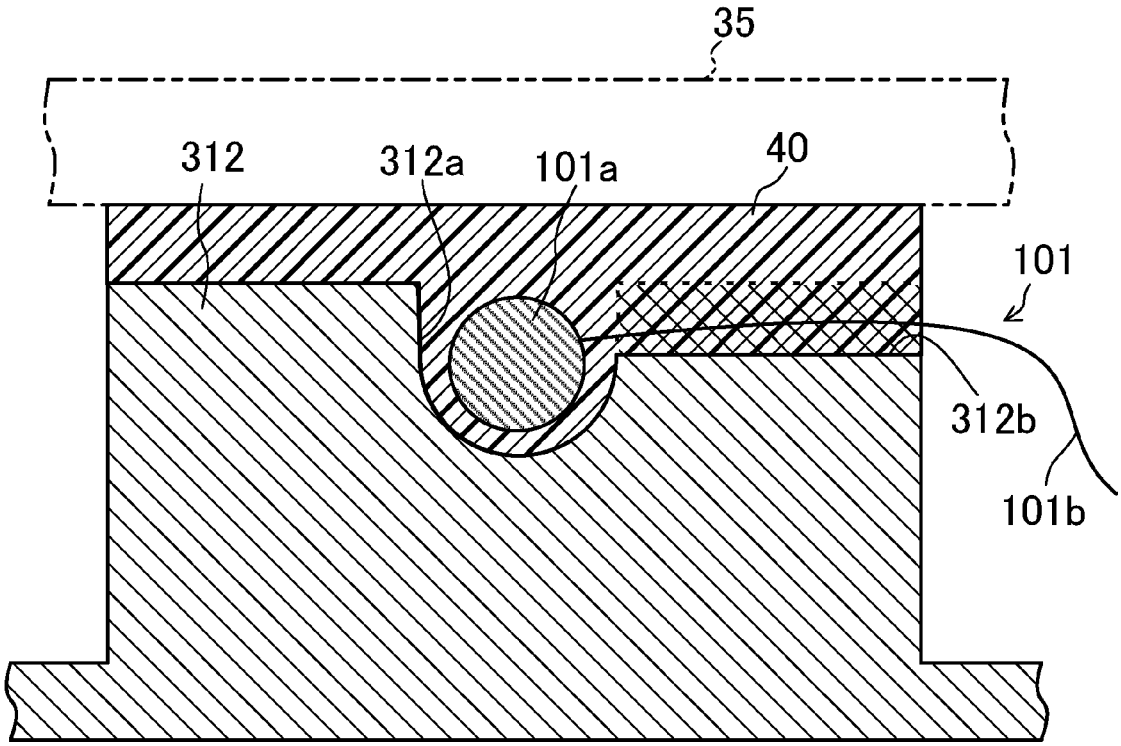
FIG. 6 is a sectional view taken along line VI-VI of FIG. 3.

As illustrated in FIG. 5 and FIG. 6, one protruding seat part 312 is formed with a concave portion 312*a*. The concave portion 312*a* is formed at the center part of the end surface of the protruding side of the one protruding seat part 312 and is opened to the image forming lens 35 side. In the concave portion 312*a*, the sensor body 101*a* is received. The protruding seat part 312 is formed at the end surface of the protruding side thereof with a wiring groove 312*b* through which the wiring 101*b* of the temperature sensor 101 passes. The wiring groove 312*b* extends toward a radial outside from an inner wall surface of the concave portion 312*a* and is opened to an outer peripheral surface of the protruding seat part 312. The wiring groove 312*b* is positioned at an opposite side of the aforementioned polygon mirror 34 side with respect to the concave portion 312*a* (see FIG. 3).

Next, an assembling direction of the aforementioned image forming lens 35 to the casing 31 will be described. The assembling direction includes a sensor arrangement step, an adhesive supply step, a lens setting step, and an adhesive curing step.

In the sensor arrangement step, as illustrated in FIG. 5 and FIG. 6, the sensor body 101*a* of the temperature sensor 101 is set in the concave portion 312*a* of one protruding seat part 312.

In the adhesive supply step, the adhesive 40 is supplied toward the concave portion 312*a*. A supply amount of the adhesive 40 is about an amount by which a part of the adhesive is overflown out of the concave portion 312*a* and is interposed between the image forming lens 35 and the one protruding seat part 312. Moreover, the adhesive 40 is also supplied to the end surface of the protruding side of the other protruding seat part 312.

In the lens setting step, the image forming lens 35 is placed on the positioning bosses 311, so that the positioning in the height direction of the image forming lens 35 is performed. Furthermore, corners of both end portions in the longitudinal direction of the image forming lens 35 are allowed to abut a positioning member 313 (illustrated only in FIG. 5) having a sectional L shape, so that the positioning in the main scanning direction of the image forming lens 35 and the positioning in a perpendicular direction thereof are performed. When the setting of the image forming lens 35 is completed, the adhesive 40 supplied in the adhesive supply step fills the space between the end surface of the protruding side of each protruding seat part 312 and the image forming lens 35 (see FIG. 4).

In the aforementioned adhesive curing step, for example, ultraviolet rays are irradiated to the adhesive 40 between each protruding seat part 312 and the image forming lens 35, so that the adhesive (a photocurable resin in the present embodiment) 40 is cured. In this way, the image forming lens 35 is fixed to a seat surface of the protruding side of each protruding seat part 312 via the adhesive 40 and the sensor body 101*a* (the temperature sensor 101) in the concave portion 312*a* of one protruding seat part 312 is fixed.

As described above, in the aforementioned embodiment, the concave portion 312*a* is formed in one of the (existing) two protruding seat parts 312 originally provided in the casing 31 and the sensor body 101*a* of the temperature sensor 101 is received in the concave portion 312*a*. In this way, for example, as compared with the case in which the sensor body 101*a* adheres to and is fixed to an upper surface (a surface opposite to the bottom wall part side of the casing 31) of the image forming lens 35, it is possible to miniaturize the entire optical scanning device 30 by reducing an installation space of the sensor body 101*a*.

Furthermore, in the aforementioned embodiment, the sensor body 101*a* is fixed by the adhesive 40 filled in the concave portion 312*a* of one protruding seat part 312. Consequently, as compared with the case in which the sensor body 101*a* adheres to and is fixed to the upper surface of the image forming lens 35, it is possible to reduce the number of adhesive curing steps.

That is, when the sensor body 101*a* has adhered to and been fixed to the upper surface of the image forming lens 35, it is necessary to perform an adhesive curing step for fixing the sensor body 101*a* to the image forming lens 35 in addition to an adhesive curing step for fixing the image forming lens to each protruding seat part 312. However, in the aforementioned embodiment, it is possible to fix the sensor body 101*a* by using the adhesive 40 for fixing the image forming lens 35 to the protruding seat part 312, so that only one-time adhesive curing step can be enough. Thus, it is possible to reduce man-hours for assembling of the optical scanning device 30.

Moreover, in the aforementioned embodiment, the wiring groove 312*b*, through which the wiring 101*b* of the temperature sensor 101 passes, is positioned at an opposite side of the aforementioned polygon mirror 34 side with respect to the concave portion 312*a*. Consequently, hot air generated at the time of rotation of the polygon mirror 34 can be suppressed from being conducted from the wiring groove 312*b* to the sensor body 101*a*. In this way, it is possible to accurately detect the temperature of the image forming lens 35 by the sensor body 101*a* without being affected by the hot air from the polygon mirror 34.

Other Embodiments

In the aforementioned embodiment, the example in which the optical scanning device 30 has been mounted in a laser printer has been described; however, the technology of the present disclosure is not limited thereto and for example, the optical scanning device 30 may also be mounted in a projector and the like.

What is claimed is:

1. An optical scanning device comprising:

a light source that emits optical beams;

a deflection unit received in a casing, deflecting the optical beams emitted from the light source, and allowing the deflected optical beams to be scanned in a main scanning direction;

an image forming lens fixed to a protruding seat part, which protrudes from a bottom wall part of the casing, by using an adhesive, and forming an image of the optical beams deflected and scanned by the deflection unit on a surface to be scanned at a constant velocity; and a temperature sensor that detects temperature of the image forming lens, wherein a concave portion is formed at an end surface of a protruding side of the protruding seat part to allow for receiving of the temperature sensor, and the adhesive is filled in the concave portion to fix the temperature sensor and is interposed between the end surface of the protruding side of the protruding seat part and the image forming lens to fix the image forming lens to the protruding seat part.

2. The optical scanning device of claim 1, wherein the temperature sensor has a sensor body received in the concave portion and a wiring connected to the sensor body, the protruding seat part is formed at the end surface of the protruding side thereof with a wiring groove that extends from an inner wall surface of the concave portion to an outer peripheral surface of the protruding seat part and allows the wiring to pass therethrough, and the wiring groove is positioned at a side opposite to a side of the deflection unit with respect to the concave portion.

3. An image forming apparatus including the optical scanning device of claim 1.

* * * * *